US007053348B1

(12) United States Patent
Terada et al.

(10) Patent No.: US 7,053,348 B1
(45) Date of Patent: May 30, 2006

(54) MICROWAVE OVEN

(75) Inventors: Mineaki Terada, Tokyo (JP); Tetsuji Kanazawa, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 11/054,938

(22) Filed: Feb. 11, 2005

(30) Foreign Application Priority Data

Dec. 8, 2004 (JP) ..... 2004-355282

(51) Int. Cl.
*H05B 6/76* (2006.01)

(52) U.S. Cl. ..... 219/739; 219/740; 126/198

(58) Field of Classification Search ..... 219/739, 219/738, 740, 741, 742, 743, 744; 126/198, 126/200; 174/35 R, 35 MS, 35 GC
See application file for complete search history.

(56) References Cited

U.S. PATENT DOCUMENTS

| | | | | |
|---|---|---|---|---|
| 3,731,035 | A * | 5/1973 | Jarvis et al. | 219/740 |
| 4,008,383 | A * | 2/1977 | Tanaka et al. | 219/740 |
| 5,942,144 | A * | 8/1999 | Lee | 219/738 |
| 5,981,927 | A * | 11/1999 | Osepchuk et al. | 219/740 |

FOREIGN PATENT DOCUMENTS

| | | |
|---|---|---|
| JP | 5-26458 | 2/1993 |
| JP | 2000-97441 | 4/2000 |
| JP | 2002-93571 | 3/2002 |
| JP | 2003-243150 | 8/2003 |

* cited by examiner

*Primary Examiner*—Quang Van
(74) *Attorney, Agent, or Firm*—Westerman, Hattori, Daniels & Adrian, LLP

(57) ABSTRACT

The invention provides a microwave oven capable of reducing the electromagnetic noises in the 2.45 GHz band generated during operation of the microwave oven. A microwave oven 1 including a microwave oven main body 2 having a heating chamber 3, and a door attached thereto. A ferrite sheet 14 disposed to cover the gap formed between the microwave oven main body 2 and the door 5 reduces the electric waves leaking through a choke groove 6 formed to a door panel 7. A punching metal plate 11 disposed on an outer side of a rear window film 10 and a wire mesh sheet 19 disposed on an inner side of a front window glass 13 shields the electric waves leaking through the window of the door 5, and the shielded electric waves are flown via a copper tape 20, an aluminum tape 17 and an EMI gasket 18 to a door case 8. Ferrite sheets 21 and 24 reduce the electric waves leaking through the gap of the door 5.

2 Claims, 7 Drawing Sheets

1. CONVENTIONAL (PRIOR ART) MICROWAVE OVEN TEST DATA

PEAK VALUE = 134.25dB $\mu$V

II. MICROWAVE OVEN TEST DATA ACCORDING TO THE PRESENT INVENT

PEAK VALUE =112.43dB $\mu$V

MICROWAVE OVEN

The present application is based on and claims priority of Japanese patent application No. 2004-355282 filed on Dec. 8, 2004, the entire contents of which are hereby incorporated by reference.

BACKGROUND OF THE INVENTION

1. Field of the Invention

The present invention relates to a microwave oven capable of reducing high frequency electric waves leaking from a heating chamber of the oven that may interfere with the wireless LAN communication on board an aircraft.

2. Description of the Related Art

A microwave oven, which is one type of a high frequency heating apparatus, utilizes the heat generation effect of microwaves in the 2.45 GHz frequency range.

The oscillating frequency of the microwave oven and the frequency of the wireless LAN (local area network) communication utilize the same ISM (industrial scientific medical) band of 2.45 GHz, so the electromagnetic noises generated from the microwave oven may interfere with the wireless LAN communication and may cause communication errors.

On the other hand, the need for internet services on board the aircraft has increased during recent years, and the need for coexistence of microwaves ovens indispensable for the customer services provided on the aircraft and the wireless LAN communication has made it necessary to reduce the electromagnetic noises generated during operation of the microwave oven.

In general, most of the microwave ovens available in the market have choke structures formed to the door for attenuating electric waves as measures for preventing the leakage of output electric waves from the heating chamber to the exterior.

Further, a punching metal plate having many holes with a diameter approximately 1 mm for shielding electric waves is attached to the window for observing the inside of the heating chamber on the door of the microwave oven, for preventing leakage of electric waves through the door.

The prior art microwave oven equipped with a door having a choke structure for attenuating leaked electric waves and a punching metal plate for shielding the leaked electric waves is disclosed in Japanese Patent Application Laid-Open Publication No. 5-26458 (patent document 1) and Japanese Patent Application Laid-Open Publication No. 2000-97441 (patent document 2).

However, according to the microwave ovens disclosed in patent documents 1 and 2, the electric waves that could not be shielded by the choke structure and the punching metal plate on the door leak out to the exterior, which is a significant amount of electric wave leakage considering the electric field strength level of wireless LAN communication, and interferes with the wireless LAN communication.

Therefore, it is necessary to further suppress the leakage of electric waves in the 2.45 GHz band that could not be shielded by the choke structure and the punching metal plate mainly equipped to the conventional microwave ovens.

However, with respect to the method for suppressing leakage of electric waves in the 2.45 GHz band, the tampering with the choke structure of the door on the microwave oven conflicts with the DHHS (Department of Health and Human Services) standard, so it is necessary to reduce the electric waves leaking out to the exterior of the heating chamber of the microwave oven without adding any arrangement to the choke structure.

SUMMARY OF THE INVENTION

With consideration of the above circumstances, the object of the present invention is to provide a microwave oven capable of reducing the output of electromagnetic noises in the 2.45 GHz band generated during operation of the microwave oven, and thereby enabling to reduce communication errors caused by radio disturbance of the wireless LAN communication.

The microwave oven according to the present invention comprises a microwave oven main body; a heating chamber for housing and heating an object to be heated formed to the interior of the microwave oven main body; and a door that can be opened and closed freely disposed to an opening of the heating chamber on the microwave oven; the door comprising a metallic door panel having formed along an outer peripheral rim thereof a choke structure for attenuating electric waves; a metallic door case mounted from a front side of the door panel and covering peripheral side walls of the door panel; a transparent rear window film disposed on a window hole of the door panel; a punching metal plate for shielding electric waves disposed on one side of the rear window film opposite from the heating chamber; and a transparent front window glass disposed on a window hole of the door case; the microwave oven further comprising a first wave absorber for absorbing electric waves positioned to cover a gap formed between the microwave oven main body and the door; a metallic shield cover having elasticity disposed on an outer side of the first wave absorber for reflecting the electric waves passing therethrough, constituting a wave absorbing trim; an aluminum tape having conductivity attached to an outer peripheral rim of the front window glass; an EMI gasket having conductivity for providing conductivity with the door case, attached on top of an aluminum tape on one side of the front window glass opposite from the heating chamber; a metallic wire mesh sheet disposed on an inner side of the front window glass for shielding electric waves; a copper tape attached to an outer peripheral rim of the wire mesh sheet for providing conductivity with the aluminum tape; a second wave absorber for absorbing electric waves disposed between a front side of the choke structure of the door panel and the copper tape; and a third wave absorber for absorbing electric waves disposed on a gap formed between an outer wall of the choke structure of the door panel and the outer peripheral wall of the door case.

According to the present invention disclosed above, as the measures for reducing the leakage of electric waves from the choke groove on the door when the microwave oven is operated, a first wave absorber is attached to a position covering the gap formed between the microwave oven main body and the door, and a metallic shield cover is attached to the outer side of the first wave absorber that constitutes a wave absorbing trim together with the wave absorber, so the electric waves leaking from the choke groove on the door panel of the door can be absorbed and reduced by the first wave absorber, and the electric waves passing through the first wave absorber can be reflected by the metallic shield cover to be absorbed again by the wave absorber.

As measures for reducing the leakage of electric waves from the window on the door when the microwave oven is operated, an aluminum tape is attached to an outer peripheral rim of the front window glass disposed on the window hole of the door case, an EMI gasket is attached on top of an aluminum tape on the side opposite from the heating chamber of the front window glass, and a copper tape is attached to the outer peripheral rim of the wire mesh sheet disposed on the inner side of the front window glass, thereby shielding the electric waves leaking through the rear window film of the door by the wire mesh sheet, and the electric waves shielded by the wire mesh sheet are conducted via the copper tape, the aluminum tape and the EMI gasket to the door case, therefore the electromagnetic noise leaked through the window on the door can be reduced.

As measures for reducing the leakage of electric waves through the gap formed to the door when the microwave oven is operated, a second wave absorber is disposed between the front side of the choke structure on the door panel and the copper tape, and a third wave absorber is disposed between the outer wall of the choke structure on the door panel and the outer peripheral wall of the door case, so the present invention is capable of absorbing and reducing the electric waves leaking through the gap between the door panel and the door case by the second wave absorber and the third wave absorber.

Further according to the microwave oven of the present invention, the wave absorbing trim is grounded via the metallic shield cover to the microwave oven main body.

According to the above invention, the electric waves leaking through the choke structure on the door panel absorbed by the first wave absorber is flown to the microwave oven main body via the metallic shield cover, so the electromagnetic wave noises leaking from the choke structure on the door can be reduced.

As described, the electromagnetic noise in the 2.45 GHz band generated during operation of the microwave oven can be reduced according to the present invention, and thus a microwave oven capable of reducing communication errors of wireless LAN communication caused by radio disturbance can be provided.

DETAILED DESCRIPTION OF THE PREFERRED EMBODIMENTS

Now, the preferred embodiment for carrying out the present invention will be described in detail with reference to the drawings.

Figure 1:
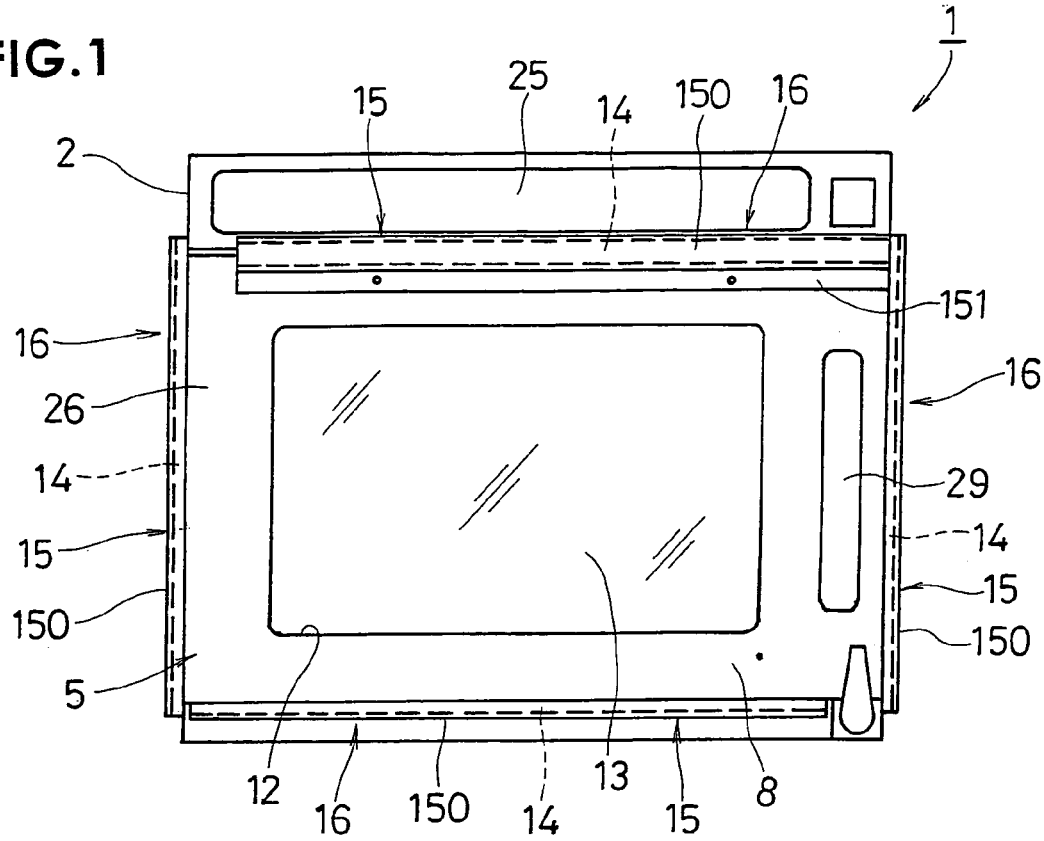
FIG. 1 is a front view showing the structure of a microwave oven according to a preferred embodiment of the present invention.
Figure 2:
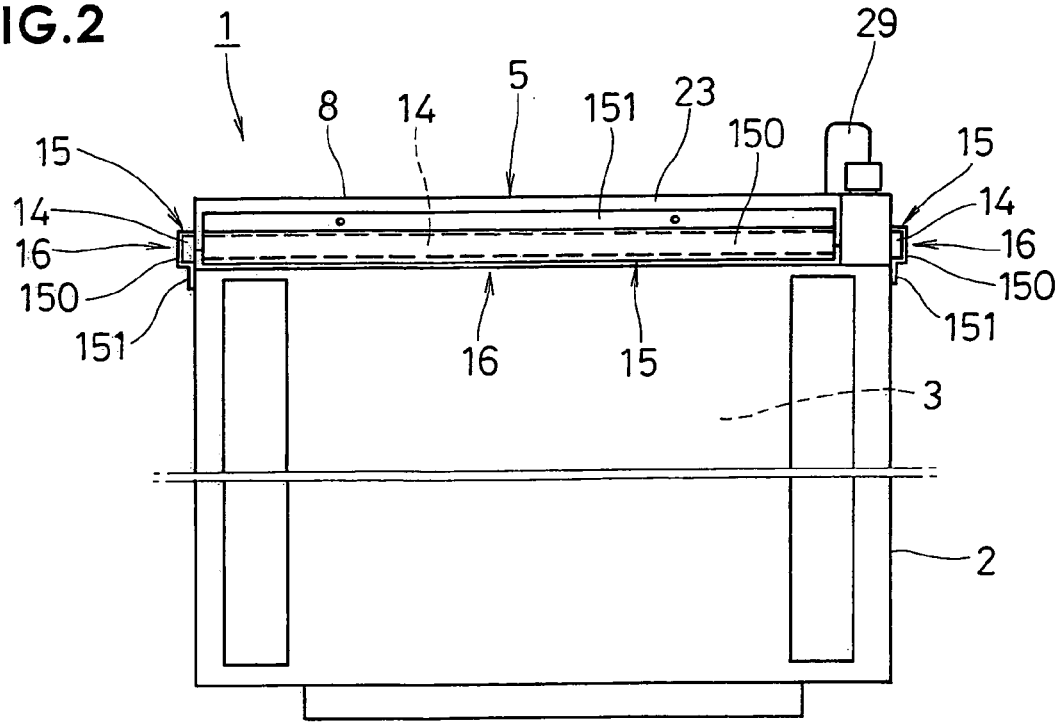
FIG. 2 is a bottom view of FIG. 1.
Figure 3:
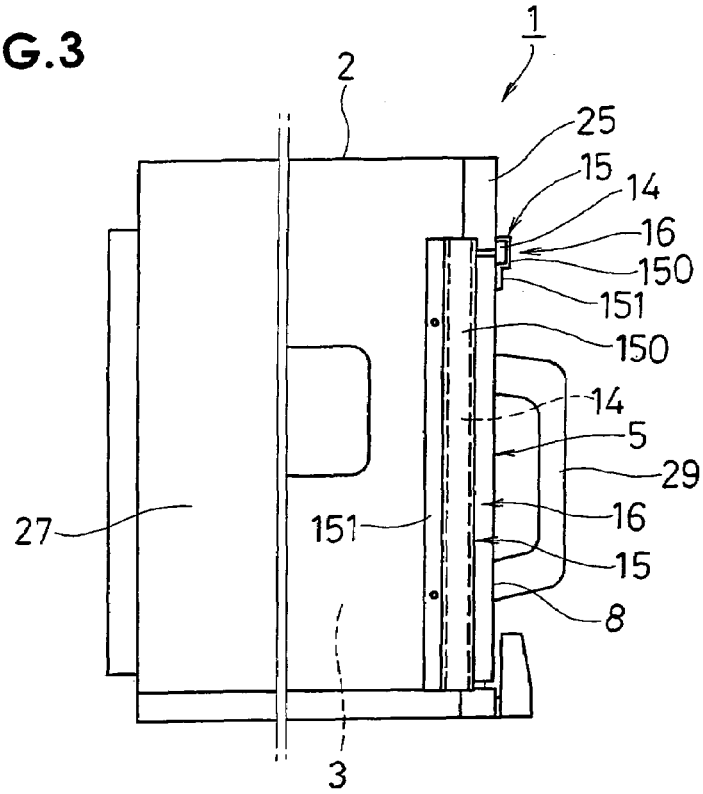
FIG. 3 is a left side view of FIG. 1.
Figure 4:
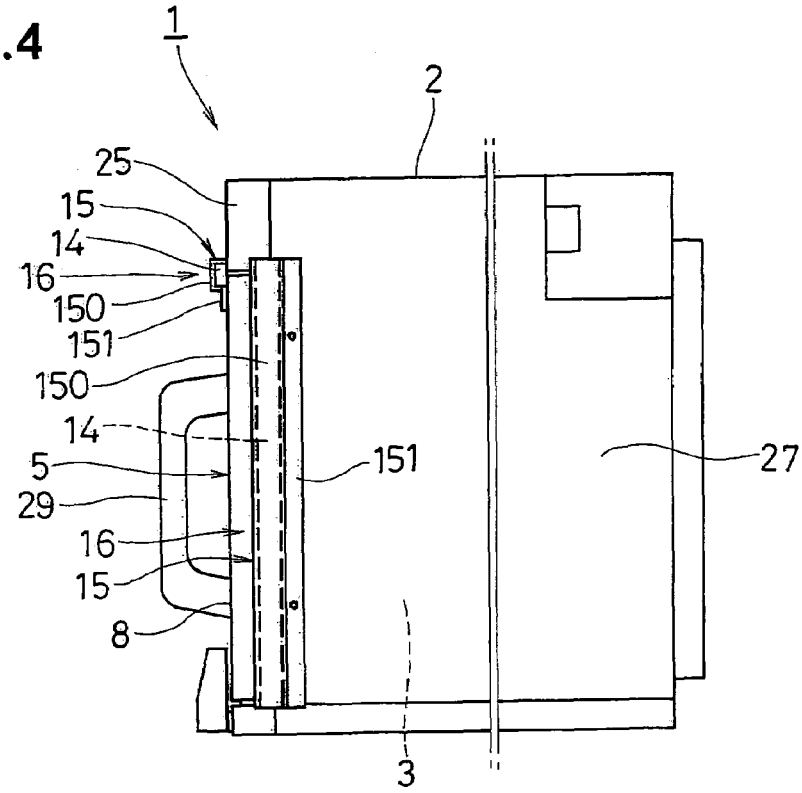
FIG. 4 is a right side view of FIG.
Figure 5:
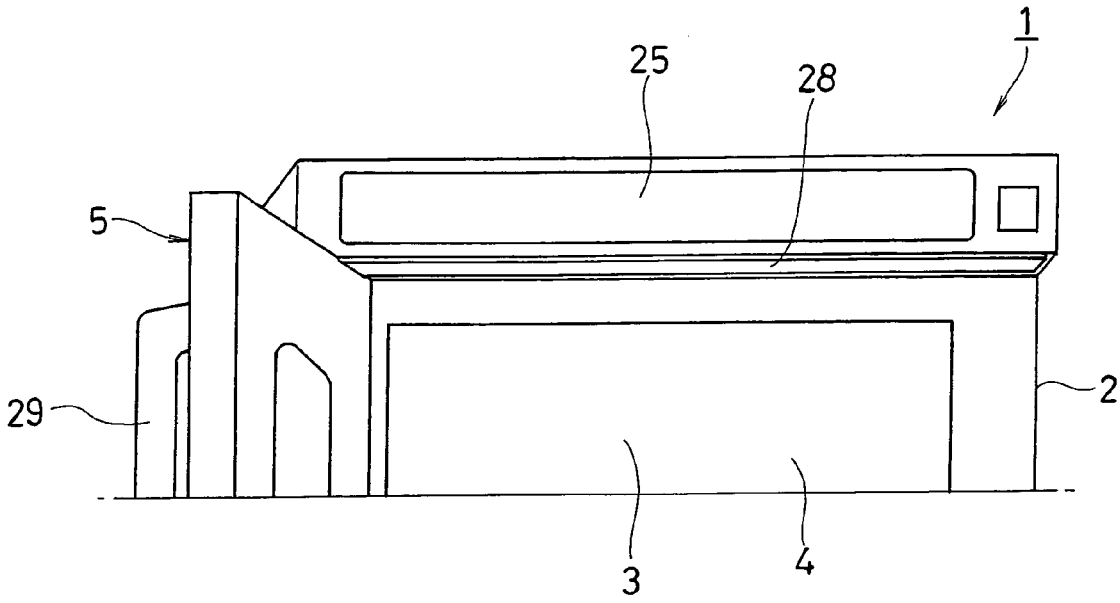
FIG. 5 is a perspective view showing the relevant portion of the microwave oven with the door opened according to the embodiment of the present invention.
Figure 6:
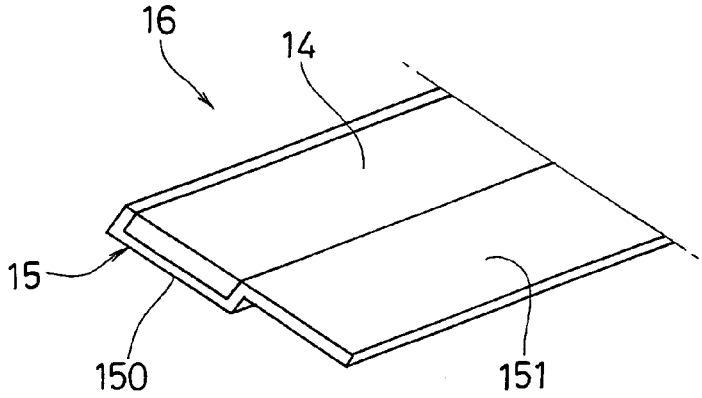
FIG. 6 is a perspective view showing the relevant portion of the structure of a wave absorbing trim of the microwave oven according to the embodiment of the present invention.
Figure 7:
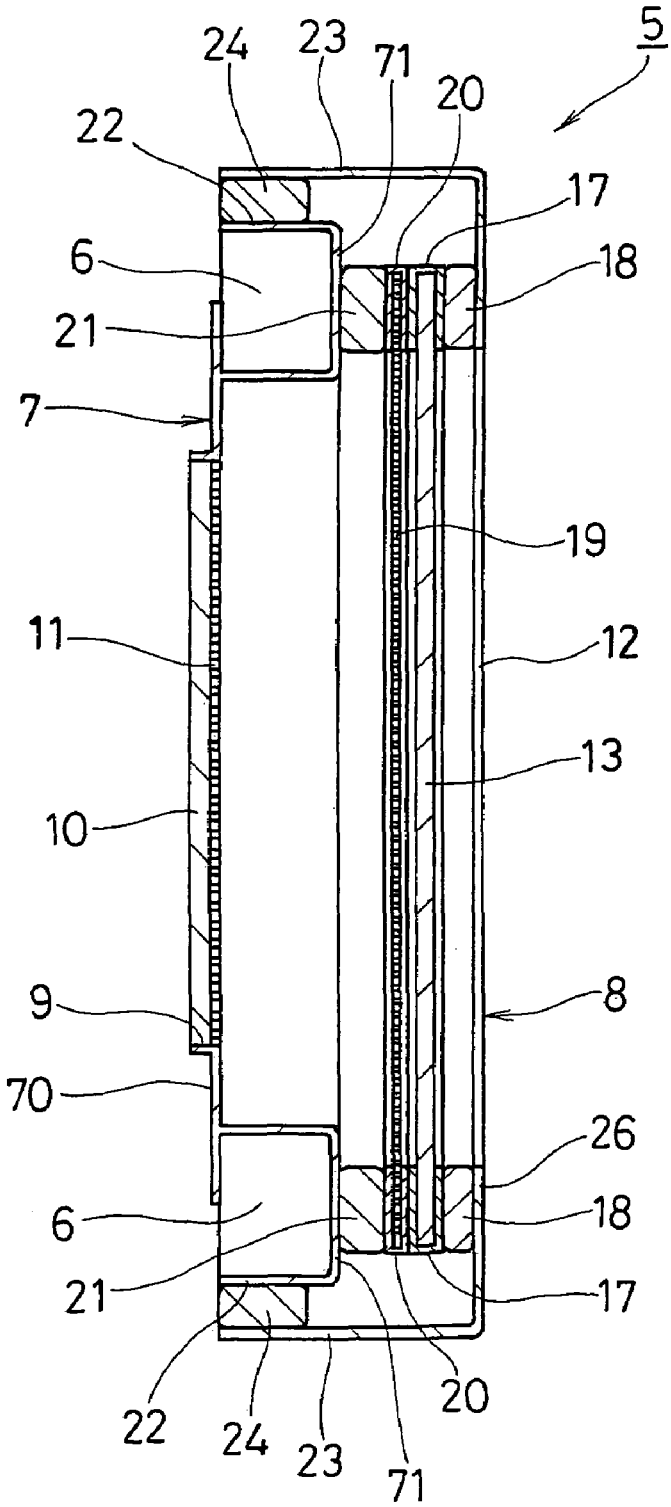
FIG. 7 is a cross-sectional side view showing the relevant portion of the door of the microwave oven according to the embodiment of the present invention.
Figure 8:
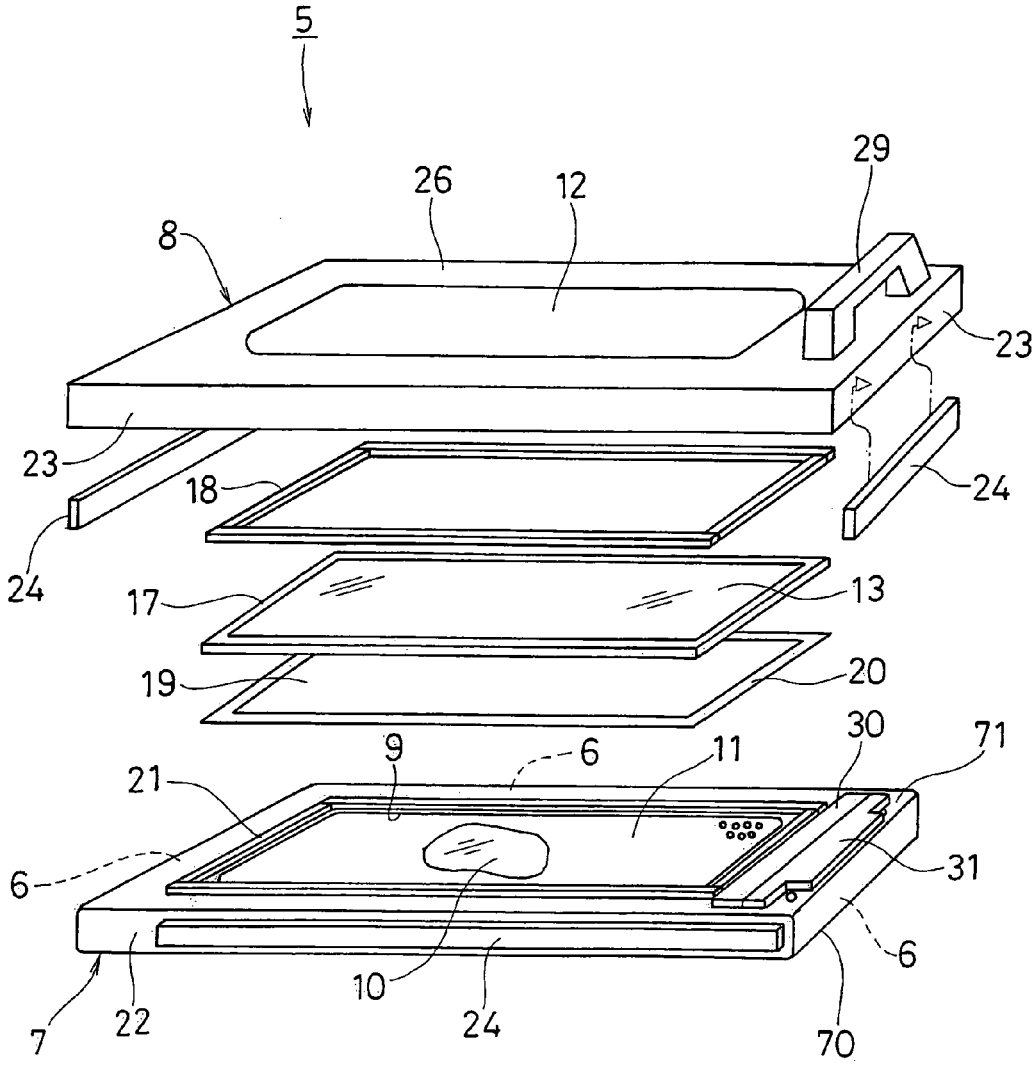
FIG. 8 is an exploded perspective view showing the structure of the door of the microwave oven according to the embodiment of the present invention.

FIG. 1 is a front view showing the structure of a microwave oven according to an embodiment of the present invention, FIG. 2 is a bottom view of FIG. 1, FIG. 3 is a left side view of FIG. 1, FIG. 4 is a right side view of FIG. 1, FIG. 5 is a perspective view showing the relevant portion of the microwave oven according to the present invention with the door opened, FIG. 6 is a perspective view showing the relevant portion of a wave absorbing trim of the microwave oven according to the present embodiment, FIG. 7 is a cross-sectional side view showing the relevant portion of the door of the microwave oven according to the present embodiment, and FIG. 8 is an exploded perspective view showing the structure of the door of the microwave oven according to the present invention.

A microwave oven 1 according to the present invention comprises a microwave oven main body 2, a heating chamber 3 formed inside the main body 2 for housing a food (not shown) or object to be heated therein and heating the same, an opening 4 that opens frontward of the heating chamber 3 on the microwave oven main body 2, and a door 5 disposed to open/close freely on the opening 4.

According to the microwave oven 1 of the present invention, the door 5 is equipped with a metallic door panel 7 having a choke groove 6 with a choke structure formed along the outer peripheral rim thereof for attenuating the electric waves, a metallic door case 8 mounted from the front side of the door panel 7 to cover the peripheral side faces, a transparent rear window film 10 disposed to engage with a window hole 9 on the door panel 7, a punching metal plate 11 disposed on the side of the rear window film 10 opposite from the heating chamber 3 for shielding the electric waves, and a transparent front window glass 13 engaged with a window hole 12 formed on the door case 8.

The microwave oven 1 according to the present invention has a ferrite sheet 14 functioning as a first wave absorber for absorbing electric waves disposed so as to cover the upper, lower and left and right side gaps formed between the microwave oven main body 2 and the door 5, and a metal shield cover 15 having elasticity disposed on the outer side of the ferrite sheet 14 for reflecting the electric waves passing through the ferrite sheet 14, which constitute a wave absorbing trim 16.

The microwave oven 1 according to the present invention has an aluminum tape 17 having electric conductivity attached to the outer peripheral rim of the front window glass 13, and an EMI (electromagnetic interference) gasket 18 having conductivity disposed on the aluminum tape 17 on the side of the front window glass 13 opposite from the heating chamber 3 so as to provide conductivity with the door case 8.

The microwave oven 1 according to the present invention further has a metallic wire mesh sheet 19 for shielding electric waves disposed on the inner side of the front window glass 13, with a copper tape 20 having conductivity disposed on the outer peripheral rim of the wire mesh sheet 19 so as to provide conductivity with the aluminum tape 17.

The microwave oven 1 according to the present invention has a ferrite sheet 21 functioning as a second wave absorber for absorbing electric waves disposed between the front side of the choke groove 6 on the door panel 7 and the copper tape 20.

The microwave oven 1 according to the present invention has a ferrite sheet 24 functioning as a third wave absorber for absorbing electric waves disposed on the gap between the outer wall 22 of the choke groove 6 on the door panel 7 and the outer peripheral wall 23 of the door case 8.

The microwave oven 1 according to the present invention has the wave absorbing trim 16 disposed on both sides of the microwave oven 2 grounded to the microwave oven main body 2 via the metallic shield cover 15.

On the front side of the main body 2 of the microwave oven 1, a door 5 is disposed on the opening 4 of the heating chamber 3 via a hinge (not shown) and capable of being opened/closed, as shown in FIGS. 1 and 5.

The microwave oven main body 2 is equipped with an operation unit 25 for operating the microwave oven 1, as shown in FIGS. 1 and 5.

A ferrite sheet (not shown) functioning as a fourth wave absorber for absorbing electric waves is attached to a notched hole (not shown) on a hinge attachment portion on the door 5 of the microwave oven 1.

On the area covering the upper gap between the door 5 and the main body 2 of the microwave oven 1 is disposed a ferrite sheet 14 along the horizontal direction as shown in FIGS. 1, 3 and 4, and on the outer side of the ferrite sheet 14 is attached a metallic shield cover 15 for covering the same.

On the area covering the lower gap between the door 5 and the main body 2 of the microwave oven 1 is disposed a ferrite sheet 14 along the horizontal direction as shown in FIGS. 1 and 2, and on the outer side of the ferrite sheet 14 is attached a metallic shield cover 15 for covering the same.

On the areas covering the gaps on the left and right sides between the door 5 and the main body 2 of the microwave oven 1 are disposed ferrite sheets 14 and 14 along the perpendicular direction as shown in FIGS. 1, 3 and 4, and on the outer side of each ferrite sheet 14 is attached a metallic shield cover 15 for covering the same.

The wave absorbing trim 16 is composed of the ferrite sheet 14 and the metallic shield cover 15, as shown in FIG. 6.

As shown in FIG. 6, the metallic shield cover 15 has a cover body 150 having an angulated U-shaped cross-section that fits on and covers the ferrite sheet 14, and an attaching block 151 extending from one side of the cover body 150.

The attaching block 151 of the metallic shield cover 15 being attached to the upper gap between the door 5 and the main body 2 of the microwave oven 1 is fixed to a front panel 26 of the door case 8 of the door 5 via an attachment tool such as a screw, as shown in FIG. 1.

The attaching block 151 of the metallic shield cover 15 being attached to the lower gap between the door 5 and the main body 2 of the microwave oven 1 is fixed to the lower area of an outer wall 23 of the door case 8 of the door 5 via an attachment tool such as a screw, as shown in FIG. 2.

The attaching block 151 of each metallic shield cover 15 being attached to the side gaps between the door 5 and the main body 2 of the microwave oven 1 is fixed to a side wall 27 of the main body 2 via an attachment tool such as a screw, as shown in FIGS. 3 and 4.

On the bottom surface of the operation unit 25 of the main body 2 of the microwave oven 1 is attached a ferrite sheet 28 functioning as a fifth wave absorber for absorbing electric waves at the upper rim of the door 5, as shown in FIG. 5.

A window hole 9 is formed to the door panel body 70 of the door panel 7 on the door 5 of the microwave oven 1, as shown in FIGS. 7 and 8, and a choke groove 6 having an angulated U-shaped cross-section opening toward the heating chamber 3 is formed to the outer rim of the door panel body 70 of the door panel 7. A choke cover (not shown) made of synthetic resin is mounted to the choke groove 6 on the door panel 7 for covering the same.

A rear window film 10 is attached to the window hole 9 on the inner side of the door panel body 70 of the door panel 7 on the door 5 of the microwave oven 1, as shown in FIGS. 7 and 8, and on the rear window film 10 on the side opposite from the heating chamber 3 is disposed a punching metal plate 11 having multiple punching holes.

A window hole 12 is formed to the front panel 26 of the door case 8 on the door 5 of the microwave oven 1, as shown in FIGS. 7 and 8, and a handle 29 is fixed to one outer side rim portion of the front panel 26 of the door case 8 to be fastened together to the door panel 7.

As shown in FIG. 7, a front window glass 13 is disposed on the window hole 12 on the inner side of the front panel 26 of the door case 8 on the door 5 of the microwave oven 1, and an aluminum tape 17 is attached to the outer rim of the front window glass 13 as shown in FIG. 8. An EMI gasket 18 that contacts the front panel 26 of the door case 8 is attached to the aluminum tape 17 on the side opposite from the heating chamber 3 of the front window glass 13, and the aluminum tape 17 is conductively connected via the EMI gasket 18 with the door case 8.

A wire mesh sheet 19 made of stainless steel is disposed on the inner side of the front window glass 13, as shown in FIG. 7, and on the outer peripheral rim of the wire mesh sheet 19 is attached a copper tape 20 that contacts the aluminum tape 17, as shown in FIG. 8, the wire mesh sheet 19 being conductively connected via the copper tape 20 with the aluminum tape 17.

A ferrite sheet 21 coming into contact with the copper tape 20 on the outer peripheral rim of the wire mesh sheet 19 is disposed in the inner rim of the window hole 9 on the outer side of a front wall 71 of the choke groove 6 in the door panel 7 on the door 5 of the microwave oven 1, as shown in FIGS. 7 and 8.

On the outer side area of the front wall 7 of the choke groove 6 positioned at one side of the window hole 9 on the door panel 7 of the door 5 of the microwave oven 1 are disposed ferrite sheets 30 and 31 that function as a sixth wave absorber for absorbing electric waves, as shown in FIG. 8.

A ferrite sheet 24 is disposed on the gap between the outer side wall 23 of the door case 8 and the outer side wall 22 of the choke groove 6 on the door panel 7 of the door 5, as shown in FIGS. 7 and 8.

First, we will describe the measures for reducing the leakage of electric waves from the choke structure formed to the door of the microwave oven.

The microwave oven 1 generates electromagnetic wave noises in the 2.45 GHz band during operation.

The electric waves leaking through the opening 4 on the main body 2 of the microwave oven 1 is attenuated by the choke groove 6 formed to the door panel 7 on the door 5.

Further, the electric waves leaking through the choke groove 6 formed to the door panel 7 on the door 5 of the microwave oven 1 are absorbed and reduced by the ferrite sheet 14 and the ferrite sheet 28, and the electric waves passing through the ferrite sheet 14 is reflected by the metallic shield cover 15 to be absorbed and reduced again by the ferrite sheet 14.

Furthermore, the electric waves that could not be absorbed by the ferrite sheet 14 of the wave absorbing trim 16 disposed on both sides of the microwave oven 1 is flown through the metallic shield cover 15 to the microwave oven main body 2.

Next, we will describe the measures for reducing the leakage of electric waves through the window on the door of the microwave oven.

The electric waves leaking through the rear window film 10 on the door 5 of the microwave oven 1 is shielded by the punching metal plate 11, and the electric waves leaking through the gap between the door panel 7 and the door case 8 are absorbed and reduced by ferrite sheet 21, ferrite sheet 24 and ferrite sheets 30 and 31.

Furthermore, the electric waves leaking through the notched hole of the hinge attachment portion on the door 5 of the microwave oven 1 is absorbed and reduced by the wave absorber.

The electric waves leaking through the punching metal plate 11 is shielded by the wire mesh sheet 19, and the electric waves shielded by the wire mesh sheet 19 is flown via the copper tape 20, the aluminum tape 17 and the EMI gasket 18 to the door case 8 of the door 5.

Thus, the electromagnetic noises in the 2.45 GHz band generated during operation of the microwave oven 1 are reduced, and the communication error caused by the radio disturbance of the wireless LAN communication can thereby be reduced.

Figure 9:
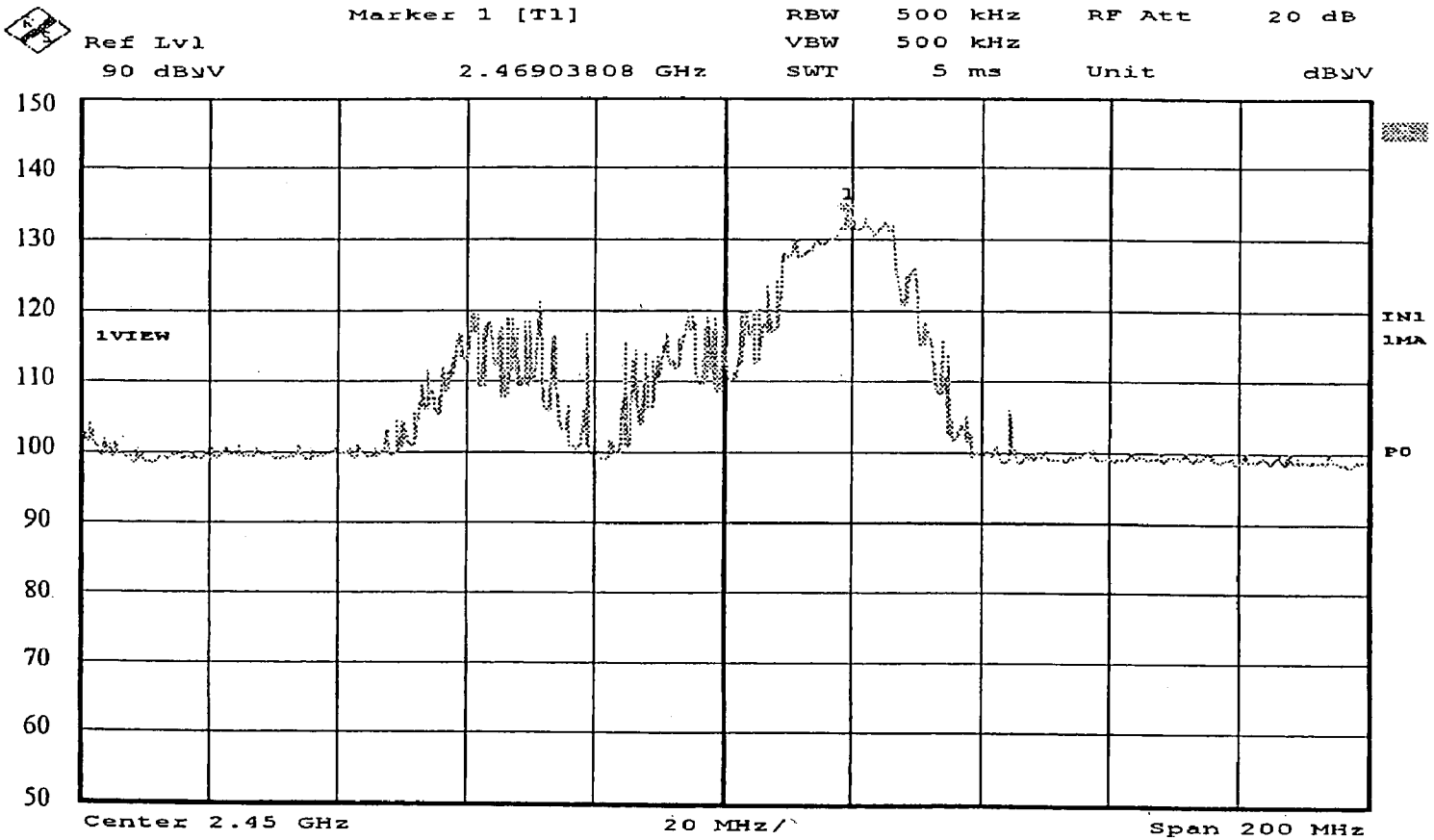
FIG. 9 is a graph showing the result of measurement of the electromagnetic noises generated during operation of the prior-art microwave oven.
Figure 10:
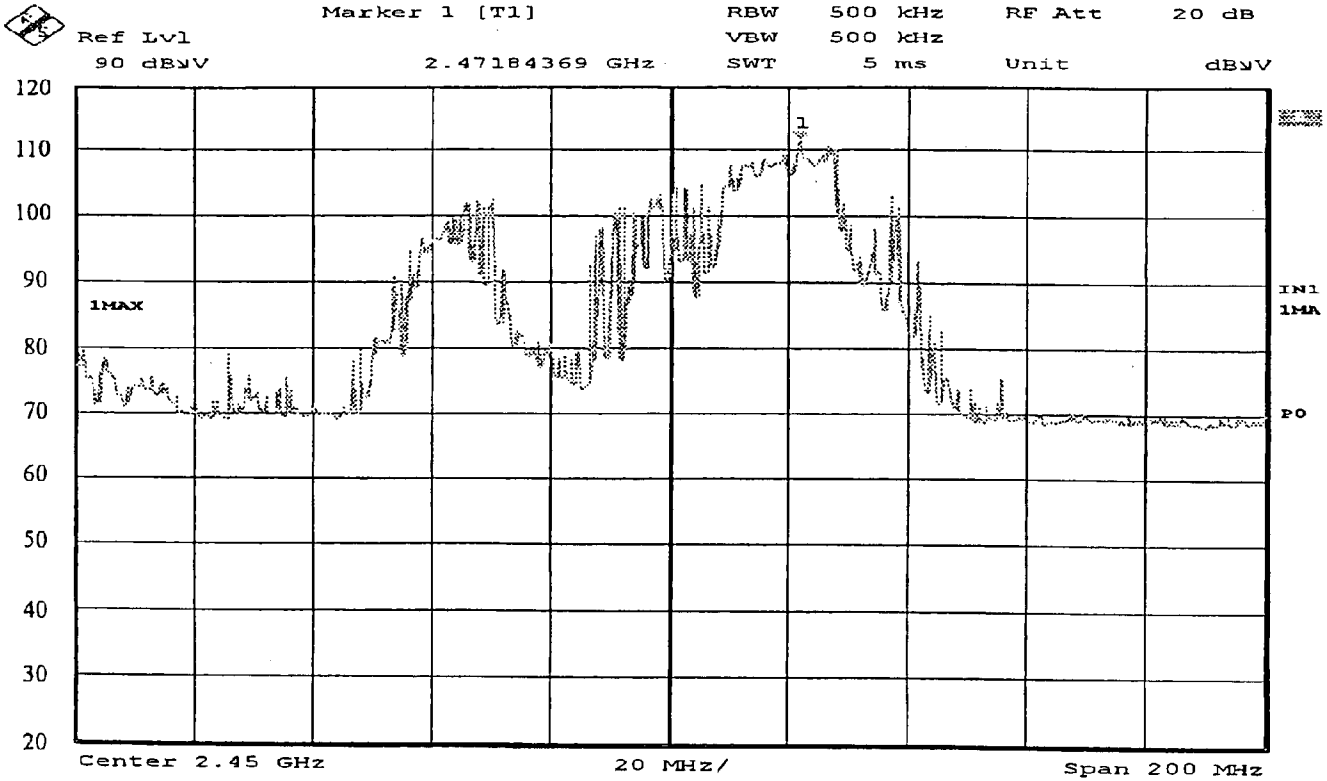
FIG. 10 is a graph showing the result of measurement of the electromagnetic noises generated during operation of the microwave oven according to the embodiment of the present invention.

FIG. 9 is a graph showing the measured result of electromagnetic noises generated during operation of the microwave oven of the prior art, and FIG. 10 is a graph showing the measured result of electromagnetic noises generated during operation of the microwave oven according to the embodiment of the present invention.

The result of measurement of the electromagnetic noises generated during operation of the prior-art microwave oven using an electromagnetic noise measuring device is shown in FIG. 9.

In FIG. 9, the horizontal axis represents the frequency and the vertical axis the represents electromagnetic noise level.

The noise peak value of the 2.45 GHz band was approximately 134 dBμV/MHz.

Furthermore, the result of measurement of the electromagnetic noises generated during operation of the microwave oven according to the present embodiment using an electromagnetic noise measuring device is shown in FIG. 10.

In FIG. 10, the horizontal axis represents the frequency and the vertical axis represents the electromagnetic noise level.

The noise peak value of the 2.45 GHz band was approximately 112 dBμV/MHz.

Now, the data of the measured result of electromagnetic noises generated during operation of the prior-art microwave oven shown in FIG. 9 is compared with the data of the measured result of electromagnetic noises generated during operation of the microwave oven according to the present embodiment shown in FIG. 10, and it has been confirmed that according to the microwave oven of the present embodiment, the noise peak value of the 2.45 GHz band was reduced by 22 dBμV/MHz.

What is claimed is:

1. A microwave oven comprising a microwave oven main body; a heating chamber for housing and heating an object to be heated formed to the interior of the microwave oven main body; and a door that can be opened and closed freely disposed to an opening of the heating chamber on the microwave oven;

the door comprising a metallic door panel having formed along an outer peripheral rim thereof a choke structure for attenuating electric waves; a metallic door case mounted from a front side of the door panel and covering peripheral side walls of the door panel; a transparent rear window film disposed on a window hole of the door panel; a punching metal plate for shielding electric waves disposed on one side of the rear window film opposite from the heating chamber; and a transparent front window glass disposed on a window hole of the door case;

the microwave oven further comprising a first wave absorber for absorbing electric waves positioned to cover a gap formed between the microwave oven main body and the door; a metallic shield cover having elasticity disposed on an outer side of the first wave absorber for reflecting the electric waves passing therethrough, constituting a wave absorbing trim; an aluminum tape having conductivity attached to an outer peripheral rim of the front window glass; an EMI gasket having conductivity for providing conductivity with the door case, attached on top of an aluminum tape on one side of the front window glass opposite from the heating chamber; a metallic wire mesh sheet disposed on an inner side of the front window glass for shielding electric waves; a copper tape attached to an outer peripheral rim of the wire mesh sheet for providing conductivity with the aluminum tape; a second wave absorber for absorbing electric waves disposed between a front side of the choke structure of the door panel and the copper tape; and a third wave absorber for absorbing electric waves disposed on a gap formed between an outer wall of the choke structure of the door panel and the outer peripheral wall of the door case.

2. The microwave oven according to claim 1, wherein the wave absorbing trim is grounded via the metallic shield cover to the microwave oven main body.

* * * * *